US005956550A

United States Patent [19]

Kim

[11] Patent Number: 5,956,550

[45] Date of Patent: Sep. 21, 1999

[54] METHOD AND DEVICE FOR PREVENTING FORMATION OF BACKGROUND IMAGE IN ELECTROPHOTOGRAPHIC IMAGE FORMING APPARATUS

[75] Inventor: Soon-Nam Kim, Suwon, Rep. of Korea

[73] Assignee: Samsung Electronics Co., Ltd., Kyungki-do, Rep. of Korea

[21] Appl. No.: 09/073,858

[22] Filed: May 7, 1998

[30] Foreign Application Priority Data

May 7, 1997 [KR] Rep. of Korea ..... 97-17556

[51] Int. Cl.[6] ..... G03G 15/06; G03G 15/00

[52] U.S. Cl. ..... 399/235; 399/159; 430/35

[58] Field of Search ..... 399/285, 159, 399/235; 430/35

[56] References Cited

U.S. PATENT DOCUMENTS

| | | | |
|---|---|---|---|
| 3,722,992 | 3/1973 | Zweig . | |
| 3,909,258 | 9/1975 | Kotz . | |
| 3,918,971 | 11/1975 | Zweig . | |
| 4,330,199 | 5/1982 | Komori et al. . | |
| 4,444,864 | 4/1984 | Takahashi . | |
| 4,448,867 | 5/1984 | Ohkubo et al. . | |
| 4,610,528 | 9/1986 | Kinashi et al. . | |
| 4,674,860 | 6/1987 | Tokunaga et al. . | |
| 4,870,460 | 9/1989 | Harada et al. . | |
| 4,954,843 | 9/1990 | Oka et al. . | |
| 5,309,209 | 5/1994 | Omori . | |
| 5,339,141 | 8/1994 | Suzuki et al. . | |
| 5,500,720 | 3/1996 | Karasawa . | |
| 5,521,683 | 5/1996 | Miyamoto et al. . | |
| 5,570,166 | 10/1996 | Ohzeki et al. . | |
| 5,708,942 | 1/1998 | Sugiyama et al. . | |
| 5,781,835 | 7/1998 | Okano et al. | 399/275 |
| 5,822,659 | 10/1998 | Ishiyama | 399/175 |

*Primary Examiner*—Richard Moses
*Attorney, Agent, or Firm*—Robert E. Bushnell, Esq.

[57] ABSTRACT

An electrophotographic image forming apparatus prevents the formation of a background image. The apparatus includes a photosensitive drum with a ground plate, and a power supply for applying a negative voltage to the ground plate in the case where the apparatus is powered on after a long time in the power-off state, or where the apparatus is powered on for many hours without forming an image. The applied negative voltage has a potential lower than a critical potential where the toner deposited on a developing roller can move to the photosensitive drum. Further, the negative voltage is applied to the ground plate, only while the charge location on the photosensitive drum rotates to reach a developing position.

14 Claims, 2 Drawing Sheets

METHOD AND DEVICE FOR PREVENTING FORMATION OF BACKGROUND IMAGE IN ELECTROPHOTOGRAPHIC IMAGE FORMING APPARATUS

CLAIM OF PRIORITY

This application makes reference to, incorporates the same herein, and claims all benefits accruing under 35 U.S.C. §119 from an application for METHOD AND DEVICE FOR PREVENTING FORMATION OF BACKGROUND IMAGE earlier filed in the Korean Industrial Property Office on May 7, 1997 and there duly assigned Ser. No. 17556/1997.

BACKGROUND OF THE INVENTION

1. Technical Field

The present invention relates to an electrophotographic image forming apparatus, and in particular, to a method and device for preventing the formation of a background image in the electrophotographic image forming apparatus.

2. Related Art

In general, an electrophotographic process is widely employed for an image forming apparatus such as a copier, a laser beam printer (LBP), an LPH (LED Print Head) printer, and a facsimile using plain paper. Such an electrophotographic process consists of the successive steps of charging→exposing→developing→transferring→fixing.

Typically, an electrophotographic image forming apparatus employs a contact charging technique by means of which a conductive roller or brush contacts a photosensitive drum to form a uniform electric potential on the surface of the drum. Moreover, the electrophotographic process typically involves a charging step, an exposing step, a developing step, a transferring step, and a fixing step.

Prior electrophotographic image forming apparatus and techniques are burdened by disadvantages. For example, the photosensitive drum has a dark attenuation characteristics; that is to say, with the lapse of time the surface potential of the charged photosensitive drum approaches, for example, 0[V] even though it is not exposed to light. Such a phenomena frequently occurs when the apparatus is powered on after a long time in the power-off state, or where the apparatus is powered on and left on for many hours without forming an image.

Therefore, there is a need for the development of a method and device for preventing the formation of a background image in an image forming apparatus, even in the case where the apparatus is powered on after a long time in the power-off state, or where the apparatus is powered on for many hours without forming an image.

The following patents are considered to be representative of the prior art, and are burdened by the disadvantages set forth herein: U.S. Pat. No. 5,500,720 to Karasawa, entitled Bias Application Control Device For Image Forming Apparatus Using Reverse Development, U.S. Pat. No. 5,339,141 to Suzuki et al., entitled Developing Device With A Developer Carrier Capable Of Forming Numerous Microfields Thereon, U.S. Pat. No. 5,309,207 to Omori, entitled Apparatus For Forming Image, U.S. Pat. No. 4,448,867 to Ohkubo et al., entitled Image Forming Method And Device For Same, U.S. Pat. No. 4,674,860 to Tokunagaet al., entitled Image Transfer Device, U.S. Pat. No. 4,444,864 to Takahashi, entitled Method For Effecting Development By Applying An Electric Field Of Bias, U.S. Pat. No. 4,330,199 to Komori et al., entitled Electrophotographic Device, U.S. Pat. No. 3,918,971 to Zweig, entitled Method For Creating Multiple Electrostatic Copies By Persistent Conductivity, U.S. Pat. No. 3,909,258 to Kotz, entitled Electrographic Development Process, U.S. Pat. No. 4,954,843 to Oka et al., entitled Electrophotographic Image Forming Apparatus, U.S. Pat. No. 4,870,460 to Harada et al., entitled Method Of Controlling Surface Potential Of Photoconductive Element, U.S. Pat. No. 3,722,992 to Zweig, entitled Apparatus For Creating An Electrostatic Latent Image By Charge Modulation, and U.S. Pat. No. 5,708,942 to Sugiyama et al., entitled Developing Device For An Image Forming Apparatus.

SUMMARY OF THE INVENTION

It is, therefore, an object of the present invention to provide a method and device for preventing a background image from being formed in an image forming apparatus, even in the case where the apparatus is powered on after a long time in the power-off state, or where the apparatus is powered on for many hours without forming an image.

To achieve the above object, there is provided an electrophotographic image forming apparatus including a photosensitive drum with a ground plate, and a power supply for applying a negative voltage to the ground plate in the case where the apparatus is powered on after a long time in the power-off state, or where the apparatus is powered on for many hours without forming an image. The applied negative voltage has a potential lower than the critical potential where the toner deposited on the developing roller can move to the photosensitive drum. Further, the negative voltage is applied to the ground plate only while the charge position on the photosensitive drum rotates to reach the developing position.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
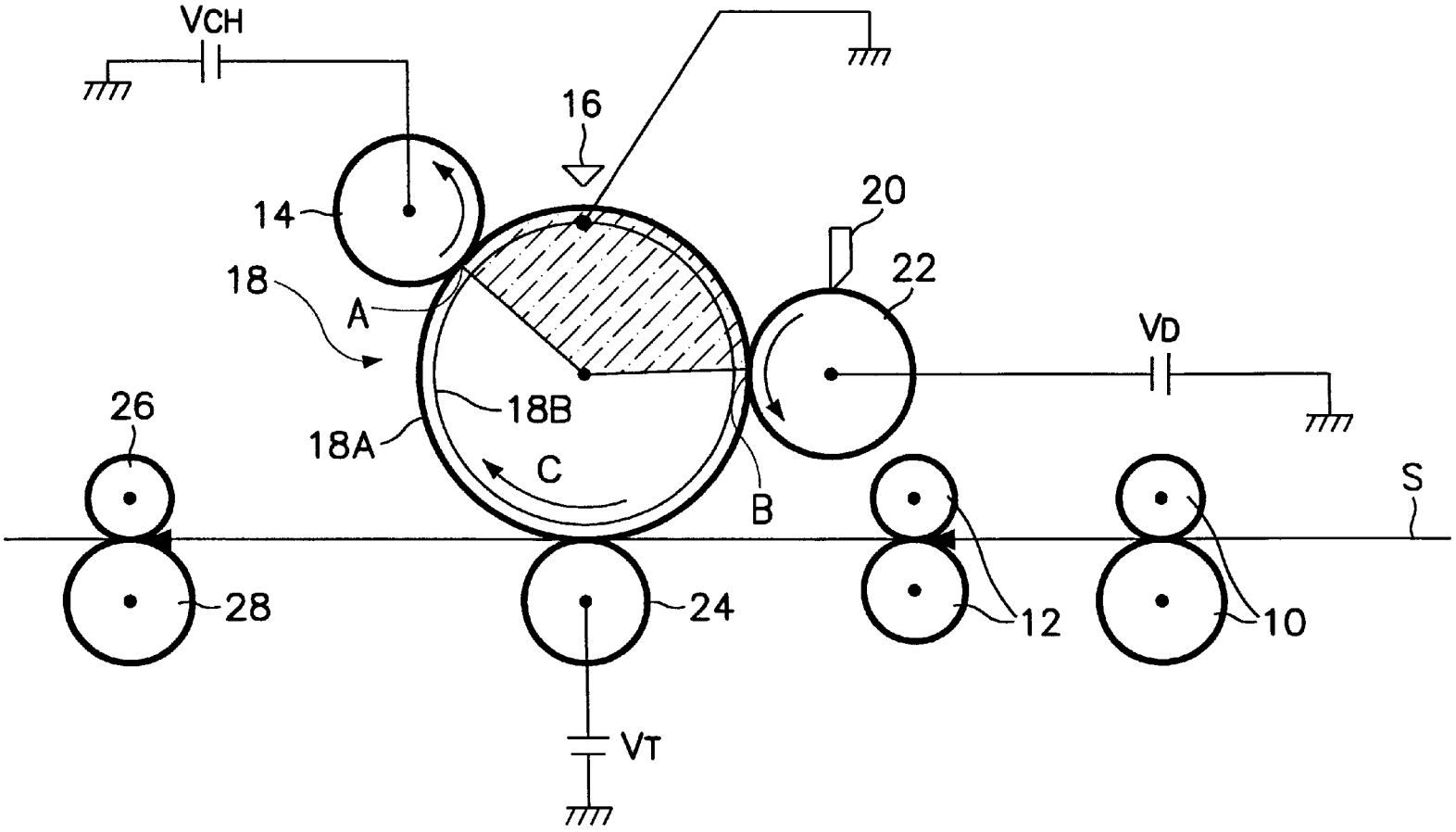
FIG. 1 is a schematic view illustrating an engine mechanism of an electrophotographic image forming apparatus.

The present invention will be described in detail with reference to the attached drawings. Like reference numerals denote the same components in the drawings, and a detailed description of related known function and structure of the present invention will be avoided if it is deemed to obscure the subject matter of the present invention.

FIG. 1 is a schematic view illustrating an engine mechanism of the electrophotographic image forming apparatus employing a contact charging technique. The contact charging technique, being widely used for the advantage that it can minimize generation of ozone due to charging, causes a conductive roller or brush used for a contact charging device to contact a photosensitive drum 18, thereby forming a uniform electric potential on the surface of the photosensitive drum 18. In particular, FIG. 1 shows the engine mechanism including a conductive roller 14 used for the contact charging device. In FIG. 1, the reference letter S represents a conveying path of a recording paper.

The electrophotographic process will be described in detail with reference to the engine mechanism of FIG. 1. The photosensitive drum 18 is rotated in the direction of arrow C by an engine driving motor (not shown) which is a main motor of the engine, in conformity with the progress of the processing steps of the electrophotographic process as described above.

First, in the charging step, the conductive roller 14 is negatively charged with a charge voltage $V_{CH}$ of, for example, −1400[V]. The conductive roller 14 charges the photosensitive drum 18 at a charge location 'A' where the conductive roller 14 contacts the photosensitive drum 18. For example, when the charge voltage $V_{CH}$ is −1400[V], a surface potential of the charged photosensitive drum 18 can be −800[V]. In this condition, conveyer rollers 10 convey the recording paper or sheet S fed from a paper feed cassette (not shown) toward register rollers 12. The register rollers 12 align the front end of the recording paper being conveyed by the conveyer rollers 10 along the conveying path. As the exposing step begins after alignment of the recording paper, the recording paper begins to be conveyed toward a transfer roller 24.

Second, in the exposing step, an exposure unit 16 irradiates a light beam corresponding to a document or image data on the surface of the charged photosensitive drum 18. For example, when the potential on an unexposed area of the photosensitive drum 18 maintains −800[V], the potential on an exposed area is changed to −50[V]. As a result, an electrostatic latent image consisting of the unexposed region of −800[V] and the exposed region of −50{V] is formed on the surface of the photosensitive drum 18. In the case of a laser beam printer, the exposure unit 16 becomes a laser scanner and, in case of the copier, it becomes a document scanner.

Third, in the developing step, a developing roller 22 is charged with a developing voltage $V_D$. Then, toner supplied from a toner cartridge (not shown) is deposited on the developing roller 22. The toner deposited on the developing roller 22 is regulated by a regulation blade 20. Herein, it is assumed that the toner deposited on the developing roller 22 has an electric potential of −300[V]. In this condition, the toner on the developing roller 22 moves to the exposed region on the photosensitive drum 18 at a developing position 'B' where the photosensitive drum 18 contacts the developing roller 22. Since the toner has a potential of −300[V] and the exposed area has a potential of −50[V], the potential difference between the toner and the exposed area is 250[V], so that the toner is moved to the exposed area on the photosensitive drum 18 by an electrostatic force, acting as an attractive force, caused by the potential difference. Meanwhile, since the unexposed area has a potential of −800[V], the potential difference between the toner and the unexposed area is −500[V] and an electrostatic force caused by the potential difference acts as a repulsive force so that the toner is not moved to the unexposed area on the photosensitive drum 18.

Fourth, in the transferring step, the toner deposited on the photosensitive drum 18 is transferred onto the recording paper by the transfer roller 24. The transfer roller 24 is provided with a transfer voltage $V_T$ of about 800–1500[V] to attract the toner on the photosensitive drum 18 toward the recording paper, thereby transferring the toner onto the recording paper.

Fifth, in the fixing step, a fixing unit consisting of a pressure roller 26 and a heat roller 28 applies pressure and heat to the toner transferred onto the recording paper so as to fix the toner image on the recording paper. After that, the recording paper is discharged from the image forming apparatus, thereby completing copying or printing for a sheet of the recording paper.

Commonly, the photosensitive drum 18 has a dark attenuation characteristic, which means that, with the lapse of time between several minutes and several tens of minutes, the surface potential of the charged photosensitive drum 18 changes to, for example, 0[V] even though it is not exposed to the light. Such a dark attenuation characteristic frequently occurs when the apparatus is powered on after a long time in the power-off state, or when the apparatus is powered on and left on for many hours without forming an image.

This dark attenuation characteristic of the photosensitive drum 18 causes formation of a background image and will be described in detail hereinbelow with reference to FIG. 1. First, it is assumed that the surface potential of the charged photosensitive drum 18 is changed to, for example, 0[V] due to the dark attenuation characteristic. In this condition, when the electrophotographic process begins, the photosensitive drum 18 rotates in the direction of an arrow C denoted therein, and accordingly, the charging roller 14 charges the photosensitive drum 18 beginning at the charge position 'A' on the photosensitive drum 18. As a result, an area preceding the charge position 'A' maintains 0[V] without being charged, until it turns around to reach the charging roller 14. At the same time, with rotation of the photosensitive drum 18, the developing roller 22 on which the toner is deposited rotates, keeping in contact with the photosensitive drum 18, beginning at the developing position 'B'.

On the other hand, the uncharged surface of the photosensitive drum 18 between the charge position 'A' and the developing position 'B' contacts the developing roller 22, with its surface potential being maintained 0[V]. Accordingly, the toner on the developing roller 22 may move undesirably to the uncharged area of the photosensitive drum 18. Furthermore, because the linear velocity of the photosensitive drum 18 is 2.2 times slower than that of the developing roller 22, the toner deposited on the developing roller 22 may be transferred to the photosensitive drum 18.

In the subsegment image forming process, the toner moved to the photosensitive drum 18 is directly transferred onto the transfer roller 24, thereby forming a background image. Moreover, the toner moved to the photosensitive drum 18 may even contaminate the charging roller 14 as the photosensitive drum 18 continues to rotate.

Figure 2:
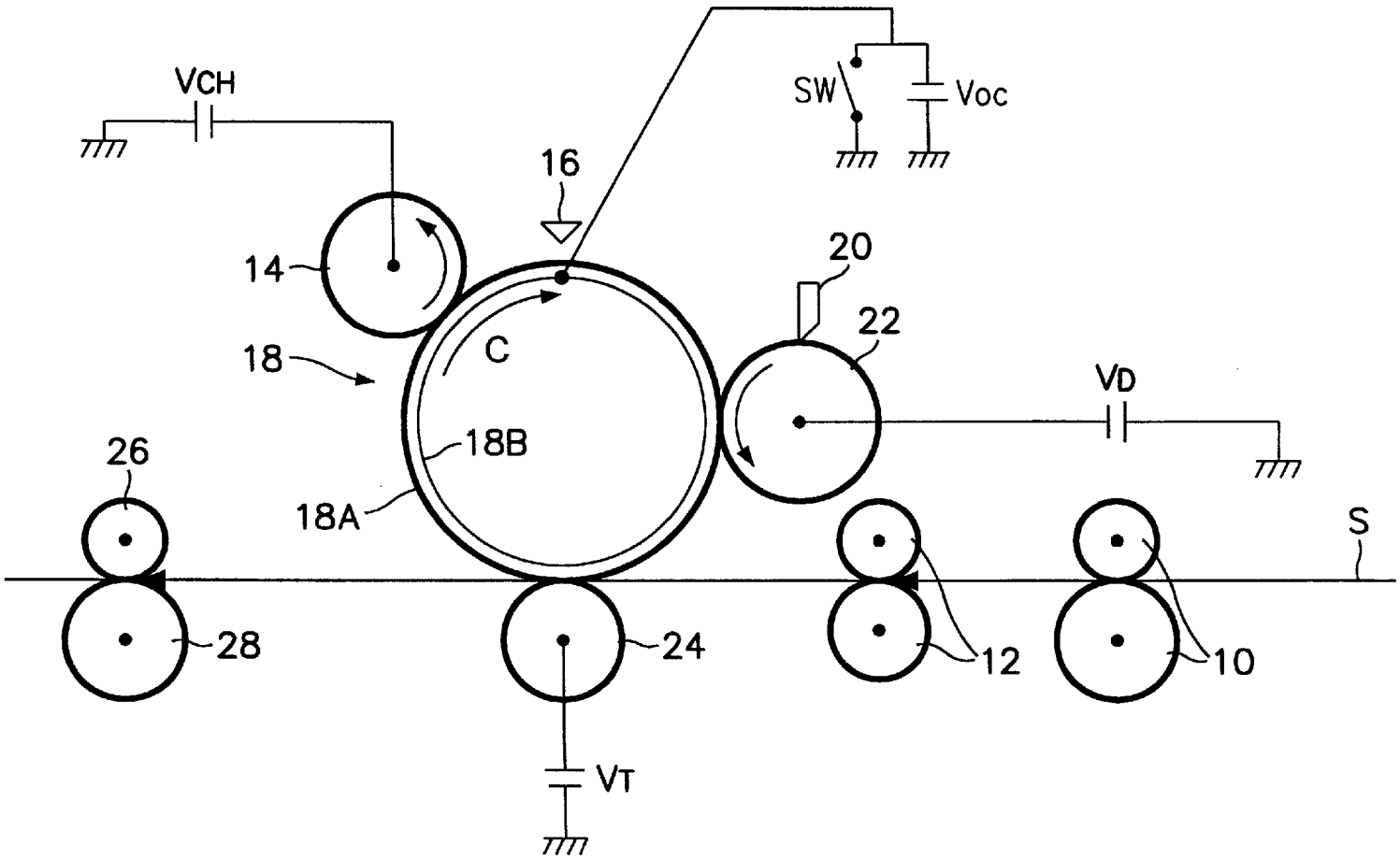
FIG. 2 is a schematic view illustrating an engine mechanism of an electrophotographic image forming apparatus according to a preferred embodiment of the present invention.

Referring to FIGS. 1 and 2, in accordance with the invention, the surface of the photosensitive drum 18 is made of an aluminum pipe 18A, which has a ground plate 18B on the inside thereof. The present invention is directed to applying a negative voltage to such constructed ground plate 18B of the photosensitive drum 18 to maintain the surface potential of the photosensitive drum 18 in at least a potential of the negative voltage, even in case where the apparatus is powered on after a long time in the power-off state, or where the apparatus is powered on for many hours without forming an image. In particular, the negative voltage is set lower than the potential of the developing roller 22. Accordingly, although the surface potential of the photosensitive drum 18 is changed due to the dark attenuation characteristic, the changed surface potential still maintains at least the potential of the negative voltage so that the toner deposited on the developing roller 22 does not move to the surface of the photosensitive drum 18.

FIG. 2 schematically illustrates an engine mechanism of an electrophotographic image forming apparatus according to a preferred embodiment of the present invention. The apparatus is similar to the arrangement shown in FIG. 1, except for the ground plate 18B of the photosensitive drum 18 to which a voltage Voc is applied. A detailed description of the parts having the same structure as those previously discussed relative to FIG. 1 will be avoided hereinbelow. Here, a power supply (not shown) provides the voltage Voc of −100[V]. Hence, the surface potential of the photosensitive drum 18 maintains −100[V] at the minimum, even in a condition where the apparatus is powered on after a long time in the power-off state or where the apparatus is powered on for many hours without forming an image. As a result, since the potential difference between the potential (−300 [V]) of the toner and the surface potential (−100[V]) of the photosensitive drum 18 becomes 200[V], the toner does not move to the surface 18B of the photosensitive drum 18. Therefore, although the apparatus is powered on after a long time in the power-off state or where the apparatus is powered on for many hours without forming an image, the background image is not formed.

Moreover, the power supply provides the voltage Voc to the ground plate of the photosensitive drum 18 only while the photosensitive drum 18 rotates from the charge position 'A' to the developing position 'B' in the case where the apparatus is powered on after a long time in the power-off state, or where the apparatus is powered on for many hours without forming an image.

Preferably, a central processing unit (CPU) (not shown) of an image forming device controls the power supply unit Voc and associated switch SW. Under the control of the CPU, the power supply unit provides the ground plate 18B of the drum 18 with the voltage Voc of −100[V]. Thus, the ground place 18B is, as shown in FIG. 2, connected to the switch SW, one end of which is grounded, and the other end of which is connected to the negative side of the power supply or battery Voc. Therefore, when the switch SW is opened, the power supply Voc provides the desired potential to the ground plate 18B. Conversely, when the switch SW is closed, the power supply Voc is grounded, and no potential is applied to ground plate 18B.

As described above, the image forming apparatus of the invention maintains the ground plate of the photosensitive drum in the specified negative potential, even in case the apparatus is powered on after a long time in the power-off state, or where the apparatus is powered on for many hours without forming an image. As a result, the toner does not move to the photosensitive drum, thereby preventing formation of the background image.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method for preventing formation of a background image in an electrophotographic image forming apparatus which includes a photosensitive drum, a charging roller for charging a surface of the photosensitive drum with rotation of the photosensitive drum, an exposure unit for irradiating a light beam on the surface of the charged photosensitive drum, and a developing roller rotating in contact with the photosensitive drum for providing an exposed surface of the photosensitive drum with toner, said method comprising the step of:

applying a negative voltage to a ground plate of said photosensitive drum, wherein a surface potential of said photosensitive drum maintains at least a potential of said negative voltage although the surface potential is changed due to a dark attenuation characteristic;

wherein a potential of said negative voltage is lower than a critical potential at which the toner deposited on the developing roller can move to said photosensitive drum.

2. The method as claimed in claim 1, wherein a power supply applies said negative voltage to said ground plate of the photosensitive drum while a charge location on said photosensitive drum rotates to reach a developing position, in a case where the apparatus is powered on after a long time in a power-off state or where the apparatus is powered on for many hours without forming an image, and wherein said charge location is a location where the photosensitive drum contacts the charging roller, and wherein said developing position is where the photosensitive drum contacts the developing roller.

3. A device for preventing formation of a background image in an electrophotographic image forming apparatus which includes a photosensitive drum, a charging roller, an exposure unit and a developing roller, said device comprising:

a ground plate connected to said photosensitive drum; and power supply means connected to said ground plate for applying a negative voltage thereto;

wherein a potential of said negative voltage is lower than a critical potential at which toner deposited on the developing roller can move to said photosensitive drum.

4. The device as claimed in claim 3, wherein said power supply means applies said negative voltage to said ground plate while a charge location on said photosensitive drum rotates to reach a developing position, in a case where the apparatus is powered on after a long time in a power-off state, or where the apparatus is powered on for many hours without forming an image, and wherein said charge location is where the photosensitive drum contacts the charging roller, and said developing position is where the photosensitive drum contacts the developing roller.

5. A method for preventing formation of a background image in an electrophotographic image forming apparatus, comprising the steps of:

providing a photosensitive drum;

rotating the photosensitive drum and charging a surface thereof;

irradiating the surface of the photosensitive drum;

providing an exposed surface of the photosensitive drum with toner; and applying a negative potential to a ground plate of said photosensitive drum, thereby preventing formation of a background image;

wherein a surface potential of said photosensitive drum maintains at least a potential of said negative voltage although the surface potential is changed due to a dark attenuation characteristic.

6. The method as claimed in claim 5, wherein a potential of said negative voltage is lower than a critical potential where toner deposited on a developing roller can move to said photosensitive drum.

7. A method for preventing formation of a background image in an electrophotographic image forming apparatus, comprising the steps of:

providing a photosensitive drum;

rotating the photosensitive drum and charging a surface thereof;

irradiating the surface of the photosensitive drum;

providing an exposed surface of the photosensitive drum with toner; and applying a negative potential to a ground plate of said photosensitive drum, thereby preventing formation of a background image;

said method further comprising the steps of providing a power supply and a ground plate of said photosensitive drum, and operating said power supply to apply said negative voltage to said ground plate of said photosensitive drum while a charge location on said photosensitive drum rotates to reach a developing position.

8. The method as claimed in claim 7, wherein said charge location is a location where the photosensitive drum contacts a charging roller, and wherein said developing position is where the photosensitive drum contacts a developing roller.

9. A device for preventing formation of a background image in an electrophotographic image forming apparatus, said apparatus including a photosensitive drum, a charging roller, an exposure unit and a developing roller;

wherein said device comprises a ground plate connected to said photosensitive drum, and power supply means connected to said ground plate for applying a negative voltage thereto; and wherein a surface potential of said photosensitive drum maintains at least a potential of said negative voltage applied to said ground plate although the surface potential is changed due to a dark attenuation characteristic.

10. The device as claimed in claim 9, wherein a potential of said negative voltage is lower than a critical potential at which toner deposited on said developing roller can move to said photosensitive drum.

11. A device for preventing formation of a background image in an electrophotographic image forming apparatus, said apparatus including a photosensitive drum, a charging roller, an exposure unit and a developing roller; and wherein said device comprises a ground plate connected to said photosensitive drum, and power supply means connected to said ground plate for applying a negative voltage thereto;

wherein said power supply means applies said negative voltage to said ground plate while a charge location on said photosensitive drum rotates to reach a developing position.

12. The device as claimed in claim 11, wherein said charge location is where the photosensitive drum contacts the charging roller.

13. The device as claimed in claim 12, wherein said developing position is where the photosensitive drum contacts the developing roller.

14. The device as claimed in claim 11, wherein said developing position is where the photosensitive drum contacts the developing roller.

* * * * *